US011148016B2

(12) United States Patent
Wakabayashi et al.

(10) Patent No.: US 11,148,016 B2
(45) Date of Patent: Oct. 19, 2021

(54) GOLF CLUB AND COMBINING MEMBER OF GOLF CLUB SHAFT AND GOLF CLUB HEAD

(71) Applicant: FUJIKURA COMPOSITES INC., Tokyo (JP)

(72) Inventors: Masaki Wakabayashi, Saitama (JP); Yoshihito Kogawa, Saitama (JP); Keigo Takahashi, Saitama (JP)

(73) Assignee: FUJIKURA COMPOSITES INC., Tokyo (JP)

( * ) Notice: Subject to any disclaimer, the term of this patent is extended or adjusted under 35 U.S.C. 154(b) by 0 days.

(21) Appl. No.: 16/489,157

(22) PCT Filed: Feb. 28, 2017

(86) PCT No.: PCT/JP2017/007621
§ 371 (c)(1),
(2) Date: Aug. 27, 2019

(87) PCT Pub. No.: WO2018/158792
PCT Pub. Date: Sep. 7, 2018

(65) Prior Publication Data

US 2019/0388740 A1 Dec. 26, 2019
US 2020/0376350 A9 Dec. 3, 2020

(51) Int. Cl.
*A63B 53/02* (2015.01)
*A63B 53/04* (2015.01)

(52) U.S. Cl.
CPC ..... *A63B 53/02* (2013.01); *A63B 53/047* (2013.01); *A63B 53/0487* (2013.01)

(58) Field of Classification Search
CPC ..... A63B 53/02; A63B 53/021
USPC ..... 473/305–315
See application file for complete search history.

(56) References Cited

U.S. PATENT DOCUMENTS 796,802 A * 8/1905 Brown ..... A63B 53/02 473/307
826,102 A * 7/1906 Hersey ..... A63B 60/00 473/308
1,167,922 A * 1/1916 Offutt ..... A63B 60/00 473/308

(Continued)

FOREIGN PATENT DOCUMENTS

CN 1082984 A 3/1994
CN 1118705 A 3/1996

(Continued)

OTHER PUBLICATIONS

International Search Report for Application No. PCT/JP2017/007621 dated Apr. 14, 2017.

(Continued)

*Primary Examiner* — Alvin A Hunter
(74) *Attorney, Agent, or Firm* — McCormick, Paulding & Huber PLLC

(57) ABSTRACT

To obtain a golf club and a combining member of a golf club shaft and a golf club head that can provide a flexibility in choice of reshafting to a user regardless of types of the golf club shaft and the golf club head. A golf club includes an inner-hosel-type golf club shaft, an over-hosel-type golf club head, and a combining member that combines the inner-hosel-type golf club shaft with the over-hosel-type golf club head.

8 Claims, 10 Drawing Sheets

(56) References Cited

U.S. PATENT DOCUMENTS

| | | | | | |
|---|---|---|---|---|---|
| 1,487,707 | A | | 3/1924 | Benton | |
| 1,652,594 | A | * | 12/1927 | Walker | A63B 53/02 473/308 |
| 1,802,507 | A | * | 4/1931 | Hadden | A63B 53/02 473/306 |
| 1,946,007 | A | * | 2/1934 | Watson | A63B 53/02 473/306 |
| 1,978,643 | A | * | 10/1934 | McKettrick | A63B 53/02 403/341 |
| 2,463,053 | A | * | 3/1949 | Pritchard | A63B 53/02 473/306 |
| 3,848,737 | A | | 11/1974 | Kenon | |
| 3,873,090 | A | | 3/1975 | Thompson | |
| 5,255,914 | A | * | 10/1993 | Schroder | A63B 53/02 473/309 |
| 5,275,408 | A | * | 1/1994 | Desbiolles | A63B 53/02 473/312 |
| 5,277,423 | A | | 1/1994 | Artus | |
| 5,439,218 | A | * | 8/1995 | Gondeck | A63B 60/00 473/308 |
| 5,626,528 | A | * | 5/1997 | Toulon | A63B 60/00 473/248 |
| 5,643,102 | A | | 7/1997 | Niswander | |
| 5,643,105 | A | * | 7/1997 | Niswander | A63B 60/00 473/308 |
| 5,769,307 | A | * | 6/1998 | Takeda | A63B 53/02 228/112.1 |
| 5,792,002 | A | * | 8/1998 | Bothwell | A63B 53/00 473/316 |
| 5,971,865 | A | * | 10/1999 | Shenoha | A63B 53/02 473/316 |
| 6,001,035 | A | * | 12/1999 | Roberts | A63B 53/02 473/562 |
| 6,039,659 | A | * | 3/2000 | Hamm | A63B 60/00 473/306 |
| 6,056,647 | A | * | 5/2000 | Tingelstad | A63B 53/0487 473/307 |
| 6,095,929 | A | * | 8/2000 | Clark | A63B 53/02 473/248 |
| 6,287,215 | B1 | * | 9/2001 | Fisher | A63B 53/007 473/309 |
| 6,561,921 | B2 | * | 5/2003 | Takeda | A63B 53/02 473/305 |
| 6,575,843 | B2 | | 6/2003 | McCabe | |
| 6,582,320 | B2 | * | 6/2003 | Fendel | A63B 53/14 473/312 |
| 6,767,422 | B1 | * | 7/2004 | Atsumi | A63B 53/10 156/184 |
| 6,966,847 | B2 | * | 11/2005 | Lenhof | A63B 53/02 473/305 |
| 7,163,463 | B2 | * | 1/2007 | Mills | A63B 60/00 473/244 |
| 7,207,897 | B2 | * | 4/2007 | Burch | A63B 53/02 473/288 |
| 7,351,159 | B2 | * | 4/2008 | Lai | A63B 60/54 473/305 |
| 7,931,542 | B2 | | 4/2011 | Kusumoto | |
| 2004/0192468 | A1 | | 9/2004 | Onoda et al. | |
| 2008/0280696 | A1 | | 11/2008 | Lau | |
| 2016/0367873 | A1 | | 12/2016 | Kogawa et al. | |

FOREIGN PATENT DOCUMENTS

| | | | | | |
|---|---|---|---|---|---|
| CN | 1522775 | A | | 8/2004 | |
| CN | 1539534 | A | | 10/2004 | |
| CN | 1602982 | A | | 4/2005 | |
| CN | 105792902 | A | | 7/2016 | |
| DE | 40 06 658 | A1 | | 8/1991 | |
| JP | S51-049172 | U | | 4/1976 | |
| JP | S59-150470 | U | | 10/1984 | |
| JP | S62-194376 | U | | 12/1987 | |
| JP | 03182265 | A | * | 8/1991 | |
| JP | 3023351 | U | | 4/1996 | |
| JP | 2000126342 | A | * | 5/2000 | |
| JP | 2000157650 | A | * | 6/2000 | |
| JP | 2000-325511 | A | | 11/2000 | |
| JP | 2001087425 | A | * | 4/2001 | |
| JP | 2001-198244 | A | | 7/2001 | |
| JP | 2001198244 | A | * | 7/2001 | |
| JP | 2002165908 | A | * | 6/2002 | A63B 53/02 |
| JP | 2002-253715 | A | | 9/2002 | |
| JP | 2005160788 | A | * | 6/2005 | |
| JP | 2005305178 | A | * | 11/2005 | A63B 53/04 |
| JP | 3120767 | U | | 4/2006 | |
| JP | 2006-297926 | A | | 11/2006 | |
| JP | 2007229225 | A | * | 9/2007 | |
| JP | 2008-114027 | A | | 5/2008 | |
| JP | 2008-307100 | A | | 12/2008 | |
| JP | 2009000221 | A | * | 1/2009 | |
| JP | 2009050676 | A | * | 3/2009 | |
| JP | 2009-66122 | A | | 4/2009 | |
| JP | 2011218120 | A | * | 11/2011 | |
| JP | 2011224367 | A | * | 11/2011 | A63B 53/02 |

OTHER PUBLICATIONS

International Search Report for Application No. PCT/JP2017/021945 dated Jul. 27, 2017.

Steal to Kikakul Putter-yo Carbon Shaft Diamana P1325 Sochaku, HOLY Blog (Kabushiki Kaisha HOLY Homepage) [online], Apr. 21, 2017 (Apr. 21, 2017), entire text, all drawings (particularly, 3rd to 5th photographs, [retrieval date Aug. 22, 2017 (Aug. 22, 2017)], Internet: <URL:http://www.e-holy.jp/blog/diamana_P135_vs_steel/>.

Office Action for Chinese Patent Application No. 201780087472.7 dated Dec. 29, 2020.

Chinese Office Action for Chinese Patent Application No. 201780091966.2 dated Aug. 31, 2020 and its English Translation.

* cited by examiner

GOLF CLUB AND COMBINING MEMBER OF GOLF CLUB SHAFT AND GOLF CLUB HEAD

CROSS REFERENCE TO RELATED APPLICATION

This application is a National Stage application of International Patent Application No. PCT/JP2017/007621 filed on Feb. 28, 2017, which is hereby incorporated by reference in its entirety.

TECHNICAL FIELD OF THE INVENTION

The present invention relates to a golf club and a combining member of a golf club shaft and a golf club head.

BACKGROUND OF THE INVENTION

As illustrated in JP-A-2000-325511, an inner hosel type and an over hosel type have been known as a combining structure of a golf club shaft and a golf club head. The inner hosel type is a type where a shaft mounting hole is formed on a hosel of the golf club head and a distal end portion of the golf club shaft is inserted into this shaft mounting hole. The over hosel type is a type where a shaft mounting shaft is formed on a hosel of the golf club head and a hollow portion of the golf club shaft is inserted onto this shaft mounting shaft.

JP-A-2001-198244 discloses that, in an over-hosel-type golf club, a prepreg in a circumferential direction containing a metal thin wire is wound around an outer periphery of a mouth portion, as a portion mounted on a golf club head, of a golf club shaft to form a reinforcing layer.

SUMMARY OF THE INVENTION

Incidentally, the golf club shaft includes a type 1 applicable to both of an inner-hosel-type golf club head and an over-hosel-type golf club head and a type 2 applicable to the inner-hosel-type golf club head but inapplicable to the over-hosel-type golf club head.

In view of this, in a conventional common general technical knowledge, even if a user who uses a golf club where the golf club shaft of the type 1 is combined with the over-hosel-type golf club head desired to reshaft to the golf club shaft of the type 2 without changing the over-hosel-type golf club head, it has been impossible to meet this desire.

Actually, at the time of selling the golf club shaft (at the time of reshafting), it is required to confirm in advance whether the golf club shaft after reshafting is insertable into the golf club head before reshafting or not. Provisionally, if it is not insertable, the user had to give up.

The present invention has been made based on the above-described awareness on the problem, and it is an object of the present invention to obtain a golf club and a combining member of a golf club shaft and a golf club head that can provide a flexibility in choice of reshafting to a user regardless of types of the golf club shaft and the golf club head.

A golf club of the present invention includes an inner-hosel-type golf club shaft, an over-hosel-type golf club head, and a combining member that combines the inner-hosel-type golf club shaft with the over-hosel-type golf club head.

It is possible that the inner-hosel-type golf club shaft has an inserted cylindrical portion, the over-hosel-type golf club head has an inserted shaft portion, and the combining member is formed of a tubular member into which the inserted cylindrical portion and the inserted shaft portion are inserted from opposite directions, and the tubular member is bonded on outer peripheral surfaces of the inserted cylindrical portion and the inserted shaft portion.

It is possible that the inserted cylindrical portion and the inserted shaft portion have distal end surfaces butted to one another inside the tubular member.

It is possible that the inner-hosel-type golf club shaft defines the inserted cylindrical portion and has an abutting stepped portion on which one end portion of the tubular member is abutted, and the over-hosel-type golf club head defines the inserted shaft portion and has an abutting stepped portion on which another end portion of the tubular member is abutted.

It is possible that the inner-hosel-type golf club shaft is formed of a golf club shaft formed of a thermally cured prepreg where a thermosetting resin is immersed in a reinforcing fiber.

It is possible that the over-hosel-type golf club head is formed of a putter club head.

It is possible that the combining member or the tubular member is formed of a combining member or a tubular member formed of a thermally cured prepreg where a thermosetting resin is immersed in a reinforcing fiber.

A combining member of a golf club shaft and a golf club head of the present invention combines an inner-hosel-type golf club shaft with an over-hosel-type golf club head.

It is possible that the combining member is formed of a tubular member into which an inserted cylindrical portion of the inner-hosel-type golf club shaft and an inserted shaft portion of the over-hosel-type golf club head are inserted from opposite directions, and the tubular member is bonded on outer peripheral surfaces of the inserted cylindrical portion and the inserted shaft portion.

The present invention can obtain the golf club and the combining member of the golf club shaft and the golf club head that can provide the flexibility in choice of reshafting to the user regardless of the types of the golf club shaft and the golf club head.

DETAILED DESCRIPTION

Figure 1:
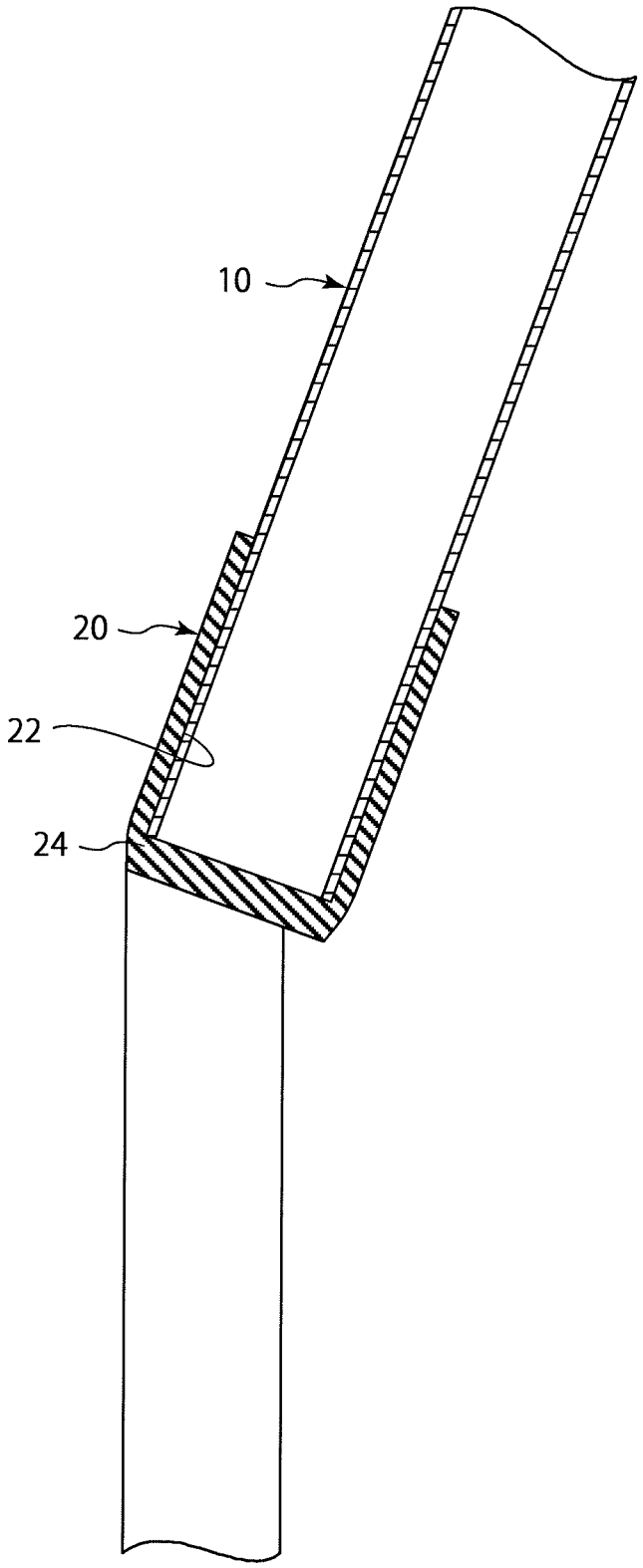
FIG. 1 is a cross-sectional view illustrating a combined portion of a steel golf club shaft and an inner-hosel-type golf club head (putter club head).

FIG. 1 is a cross-sectional view illustrating a combined portion of a steel golf club shaft 10 and an inner-hosel-type golf club head (putter club head) 20.

The steel golf club shaft 10 is configured from a hollow tubular member having relatively a thin wall and a large inner diameter (compared with a carbon golf club shaft 30, which is described later).

The inner-hosel-type golf club head 20 has a hosel 24 on which a shaft insertion hole 22 is formed. The shaft insertion hole 22 has an inner diameter that is set identical to or slightly larger than an outer diameter of the steel golf club shaft 10. The steel golf club shaft 10 is combined with the inner-hosel-type golf club head 20 by inserting a distal end portion (an outer diameter portion) of the steel golf club shaft 10 into the shaft insertion hole 22 of the inner-hosel-type golf club head 20 to be bonded.

Figure 2:
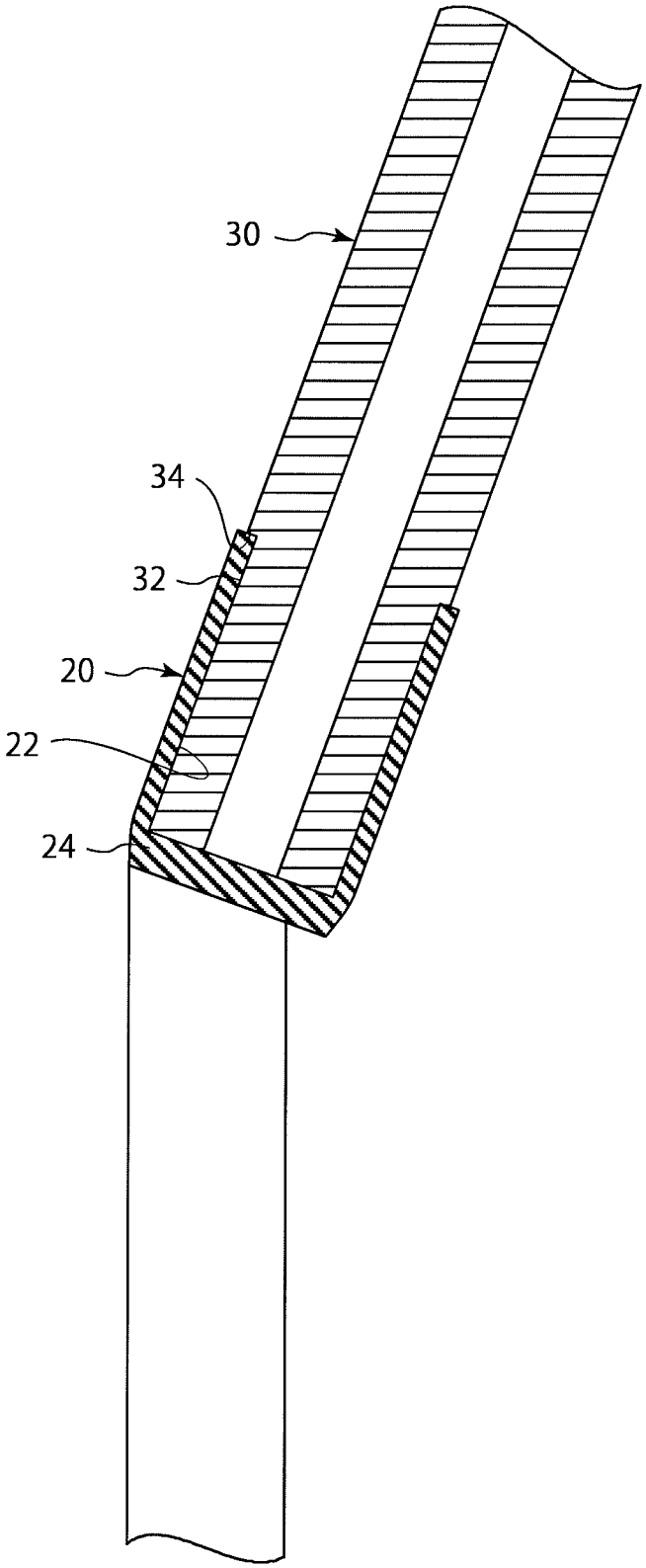
FIG. 2 is a cross-sectional view illustrating a combined portion of a carbon golf club shaft and the inner-hosel-type golf club head (putter club head).
Figure 3:
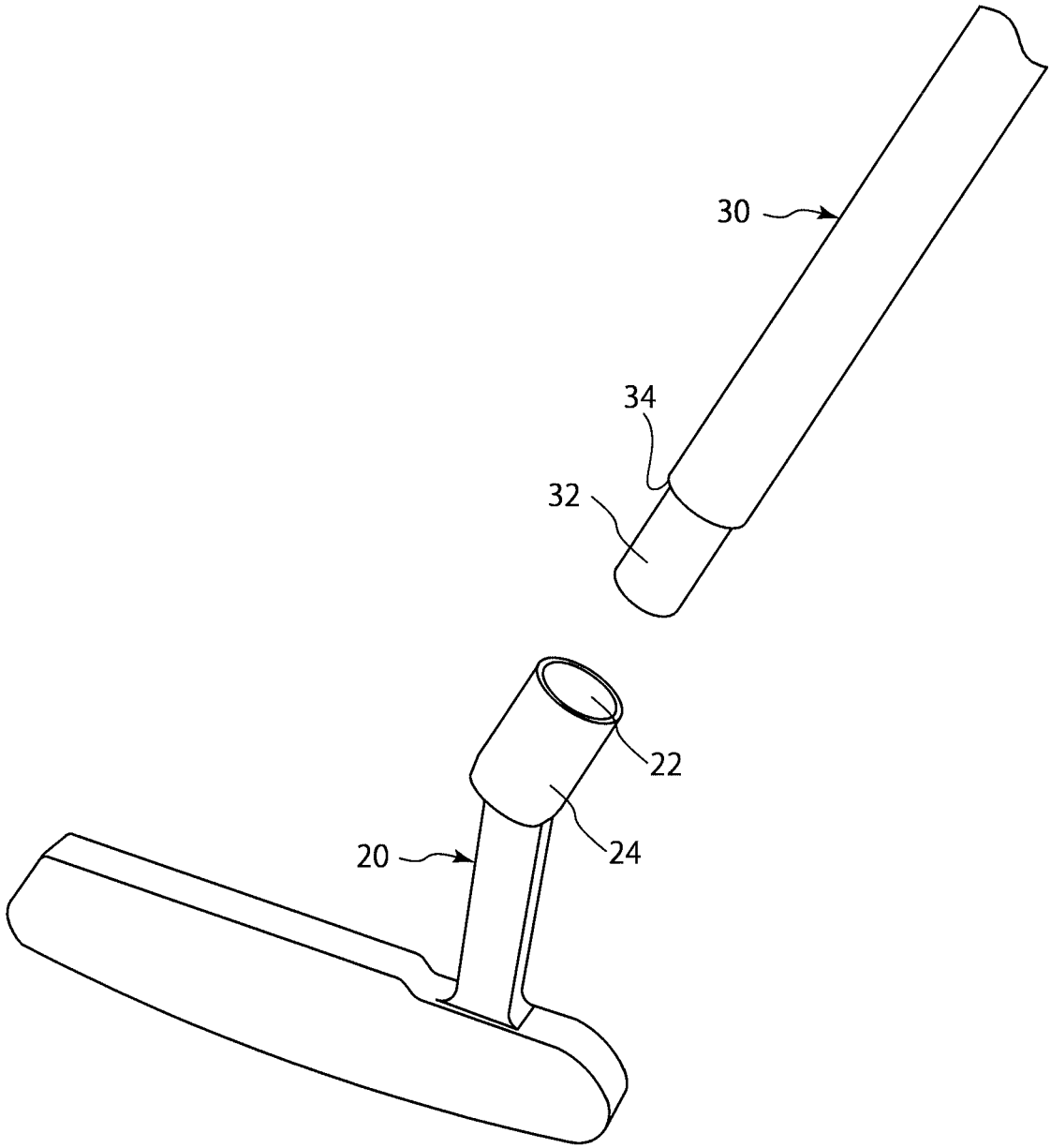
FIG. 3 is a perspective view illustrating a separation state of the carbon golf club shaft and the inner-hosel-type golf club head (putter club head).
Figure 4:
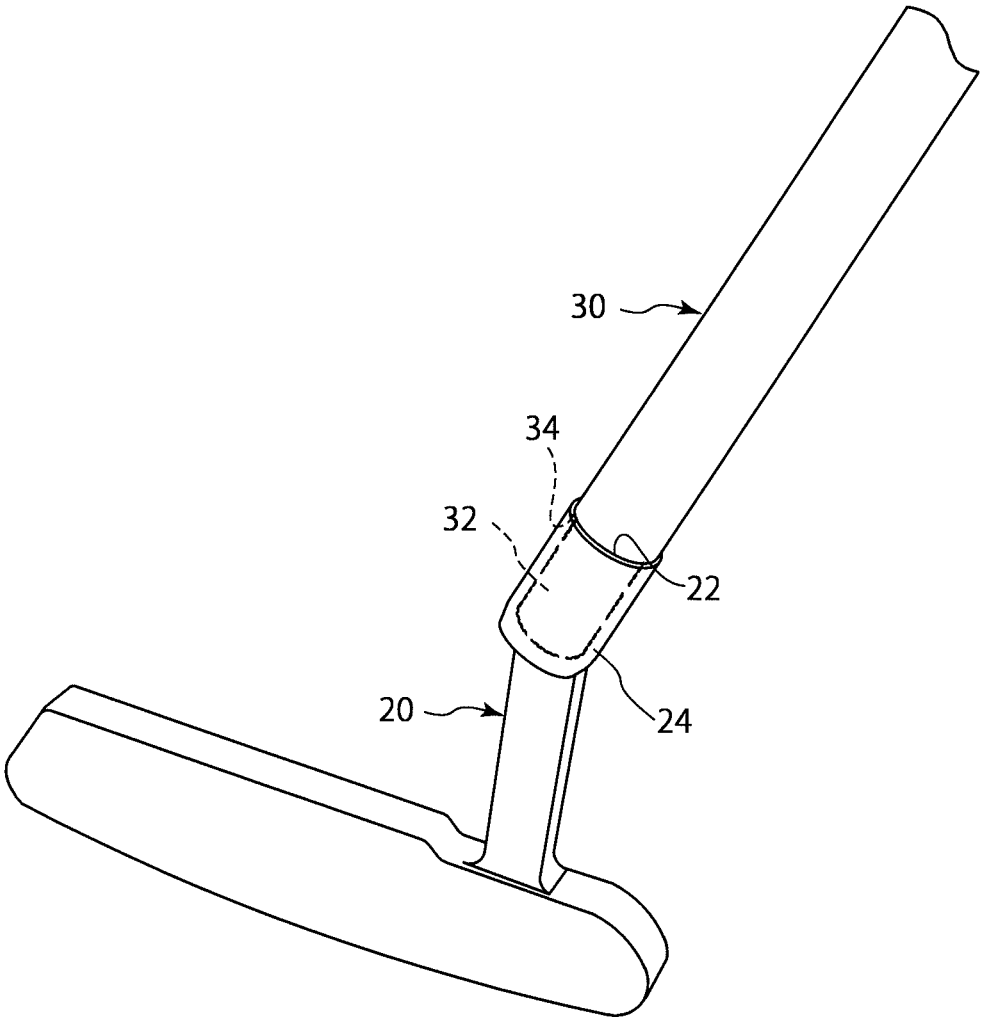
FIG. 4 is a perspective view illustrating a combined state of the carbon golf club shaft and the inner-hosel-type golf club head (putter club head)

FIG. 2 is a cross-sectional view illustrating a combined portion of the carbon (Carbon Fiber Reinforced Plastics (CFRP)) golf club shaft 30 and the inner-hosel-type golf club head (putter club head) 20. FIG. 3 and FIG. 4 are perspective views illustrating a separation state and a combined state of the carbon golf club shaft 30 and the inner-hosel-type golf club head (putter club head) 20.

The carbon golf club shaft 30 is formed of a thermally cured prepreg where a thermosetting resin is immersed in a carbon fiber. The carbon golf club shaft 30 is configured from a hollow tubular member having relatively a thick wall and a small inner diameter (compared with the above-described steel golf club shaft 10). An inserted cylindrical portion (an opposite cylindrical portion) 32 and an abutting stepped portion 34, which defines this inserted cylindrical portion 32, are formed on a distal end side of the carbon golf club shaft 30. The inserted cylindrical portion 32 extends in an axial direction. The abutting stepped portion 34 extends in a direction perpendicular to the axis. The carbon golf club shaft 30 is combined with the inner-hosel-type golf club head 20 by inserting the inserted cylindrical portion 32 of the carbon golf club shaft 30 into the shaft insertion hole 22 of the inner-hosel-type golf club head 20 to be bonded.

Figure 5:
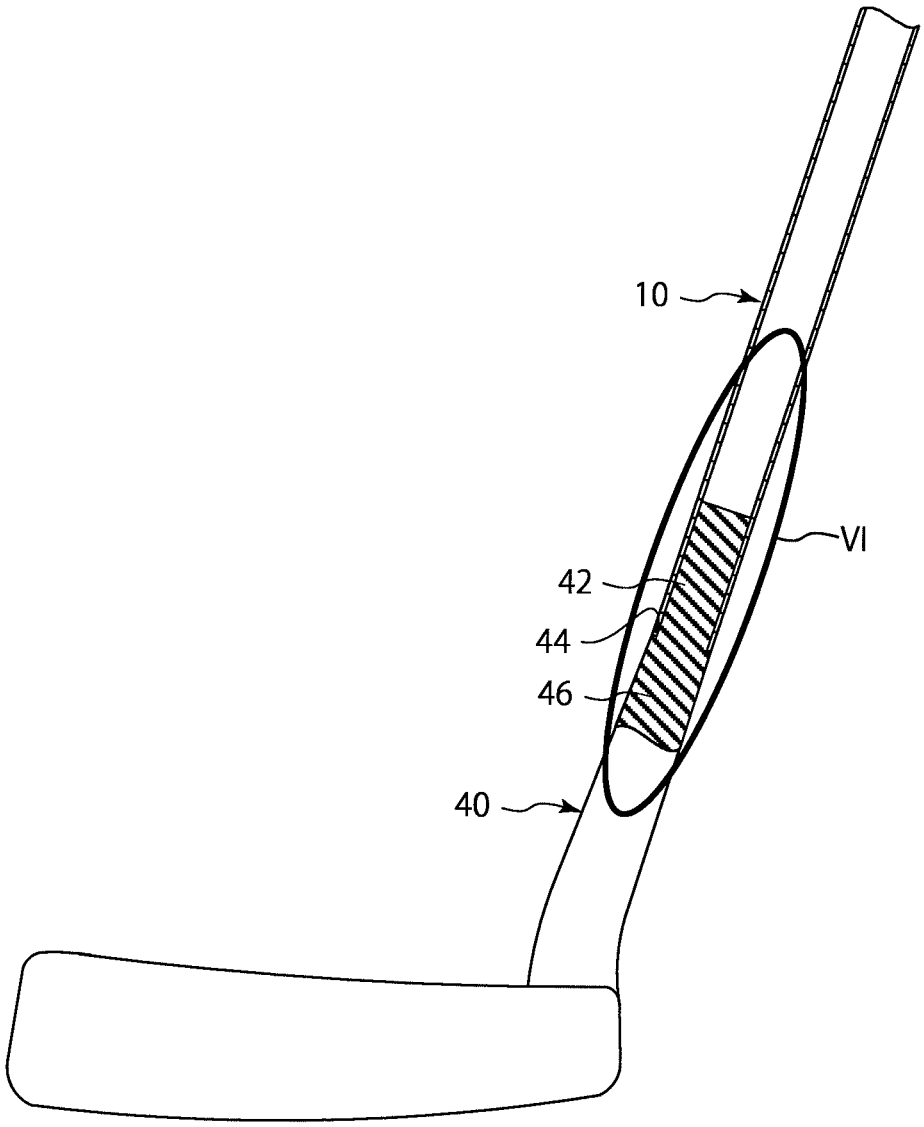
FIG. 5 is a cross-sectional view illustrating a combined portion of the steel golf club shaft and an over-hosel-type golf club head (putter club head).
Figure 6:
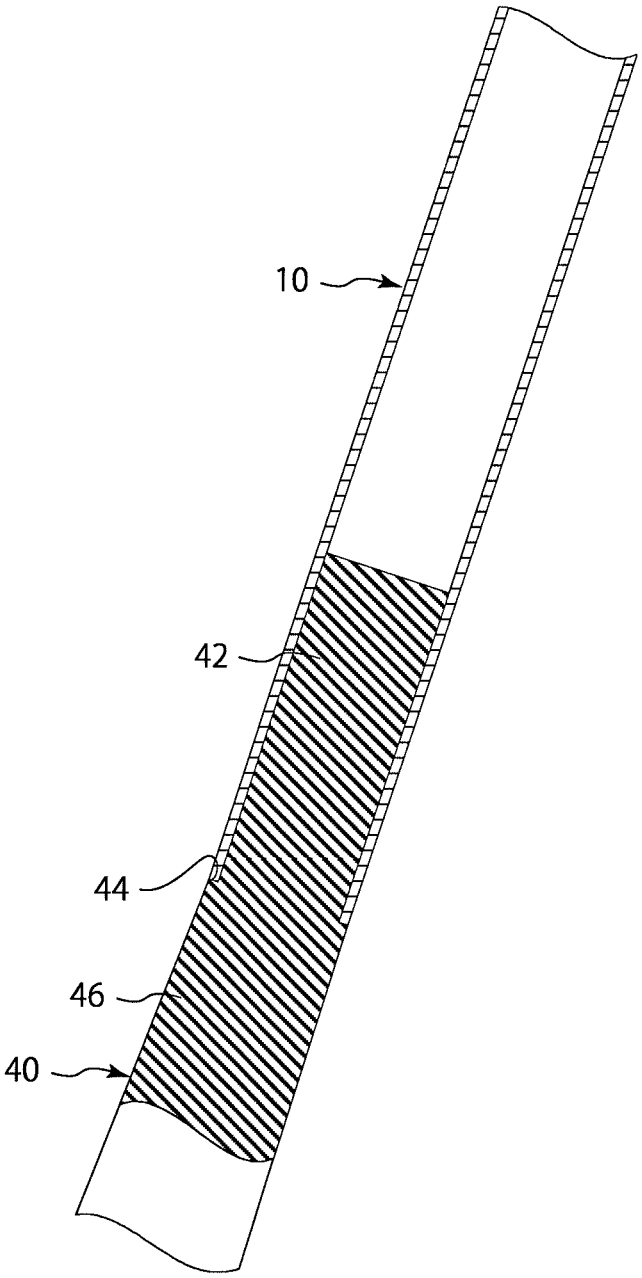
FIG. 6 is an enlarged view of a part VI in FIG. 5.

FIG. 5 is a cross-sectional view illustrating a combined portion of the steel golf club shaft 10 and an over-hosel-type golf club head (putter club head) 40. FIG. 6 is an enlarged view of a part VI in FIG. 5.

The over-hosel-type golf club head 40 has a hosel 46 on which an inserted shaft portion (an opposite shaft portion) 42 and an abutting stepped portion 44, which defines this inserted shaft portion 42, are formed. The inserted shaft portion 42 extends in an axial direction. The abutting stepped portion 44 extends in a direction perpendicular to the axis. The inserted shaft portion 42 has an outer diameter set identical to or slightly smaller than an inner diameter of the steel golf club shaft 10. The steel golf club shaft 10 is combined with the over-hosel-type golf club head 40 by inserting a distal end portion (an inner diameter portion) of the steel golf club shaft 10 into the inserted shaft portion 42 of the over-hosel-type golf club head 40 to be bonded.

Thus, the steel golf club shaft 10 is combinable with (mountable on, insertable into) both of the inner-hosel-type golf club head 20 and the over-hosel-type golf club head 40. In this mean, the steel golf club shaft 10 doubles as an "inner-hosel-type golf club shaft" and an "over-hosel-type golf club shaft" (a golf club shaft of a type double as the inner hosel/the over hosel).

In contrast, the carbon golf club shaft 30 is combinable with (mountable on, insertable into) the inner-hosel-type golf club head 20 but is not combinable with (not mountable on, not insertable into) the over-hosel-type golf club head 40. In this mean, the carbon golf club shaft 30 is an "inner-hosel-type golf club shaft (inner-hosel-dedicated-type golf club shaft)."

A reason why the carbon golf club shaft 30 is not combinable with the over-hosel-type golf club head 40 includes that the carbon golf club shaft 30 has to have a thick wall and a small inner diameter to guarantee strength, thus being not insertable into the inserted shaft portion 42 of the over-hosel-type golf club head 40.

In view of this, in a conventional common general technical knowledge, even if a user who uses a golf club (FIG. 5, FIG. 6) where the steel golf club shaft 10 is combined with the over-hosel-type golf club head 40 desired to reshaft to the carbon golf club shaft 30 without changing the over-hosel-type golf club head 40, it has been impossible to meet this desire.

Actually, at the time of selling the golf club shaft (at the time of reshafting), it is required to confirm in advance whether the golf club shaft after reshafting is insertable into the golf club head before reshafting or not. Provisionally, if it is not insertable, the user had to give up.

The inventors, considering this point as an important technical problem, have succeeded in combination of the carbon golf club shaft (the inner-hosel-type golf club shaft) 30 and the over-hosel-type golf club head (putter club head) 40 using a tubular member (a combining member) 50 as an outside attachment to provide flexibility in choice of reshafting to the user regardless of types of the golf club shaft and the golf club head.

Figure 7:
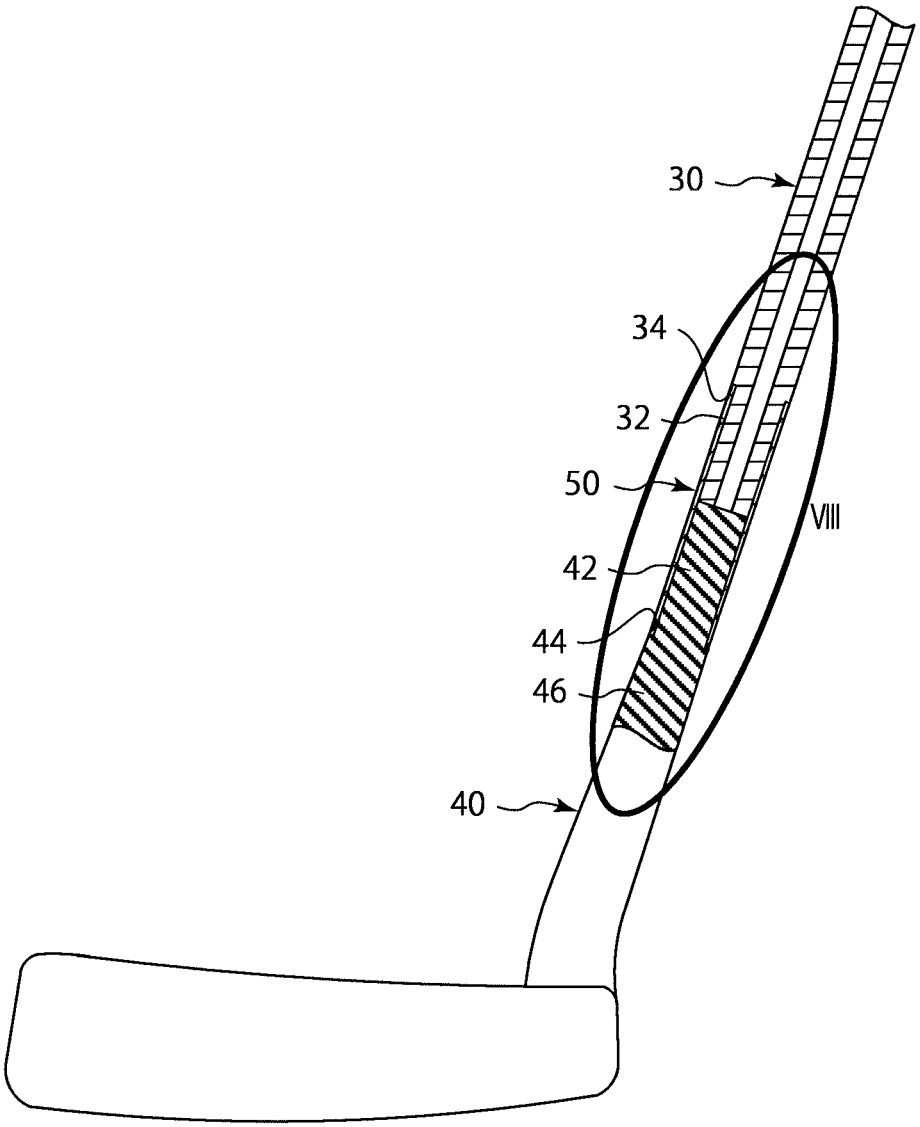
FIG. 7 is a cross-sectional view illustrating a combined portion of the carbon golf club shaft, the over-hosel-type golf club head (putter club head), and a tubular member.
Figure 8:
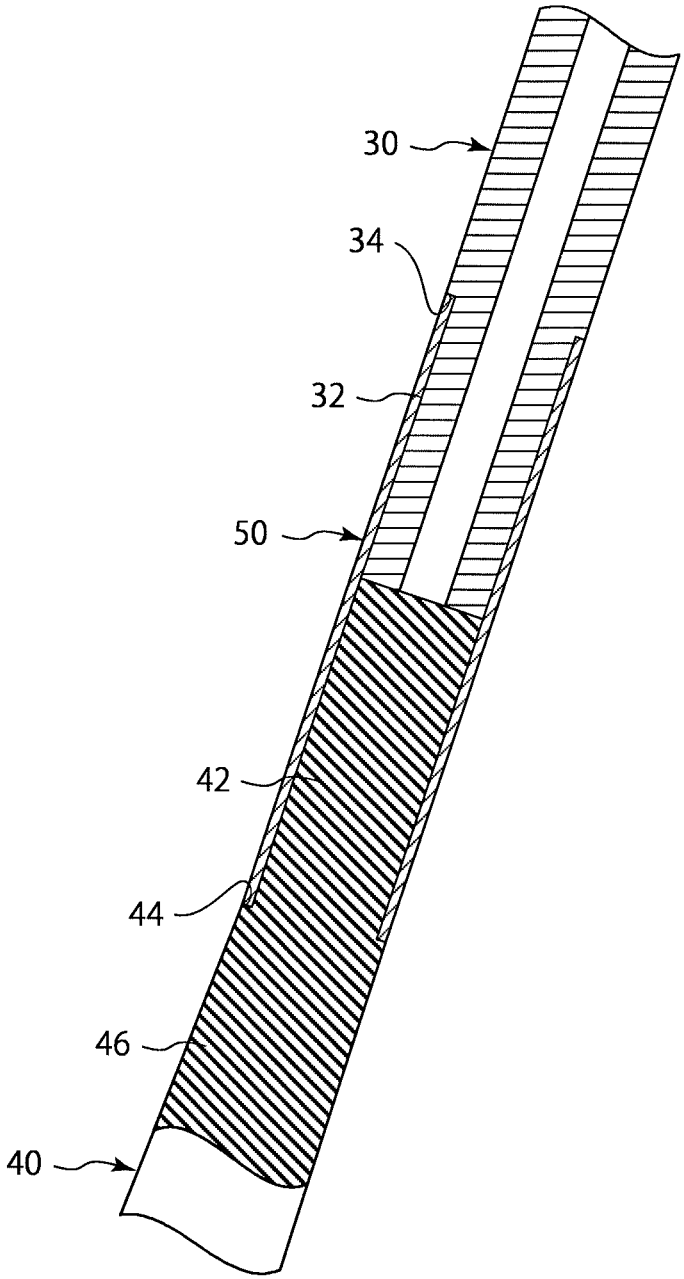
FIG. 8 is an enlarged view of a part VIII in FIG. 7.
Figure 9:
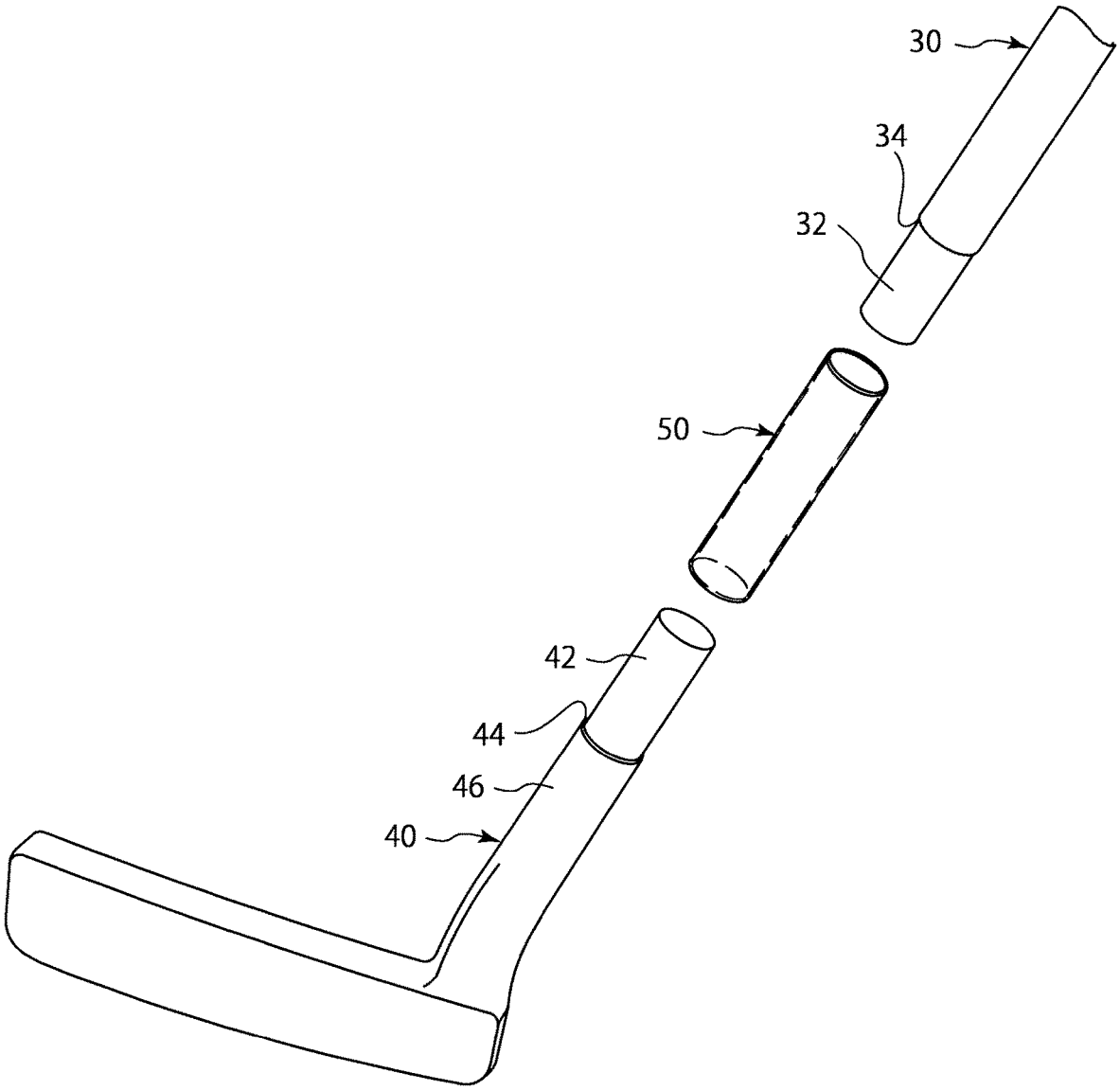
FIG. 9 is a perspective view illustrating a separation state of the carbon golf club shaft, the over-hosel-type golf club head (putter club head), and the tubular member.
Figure 10:
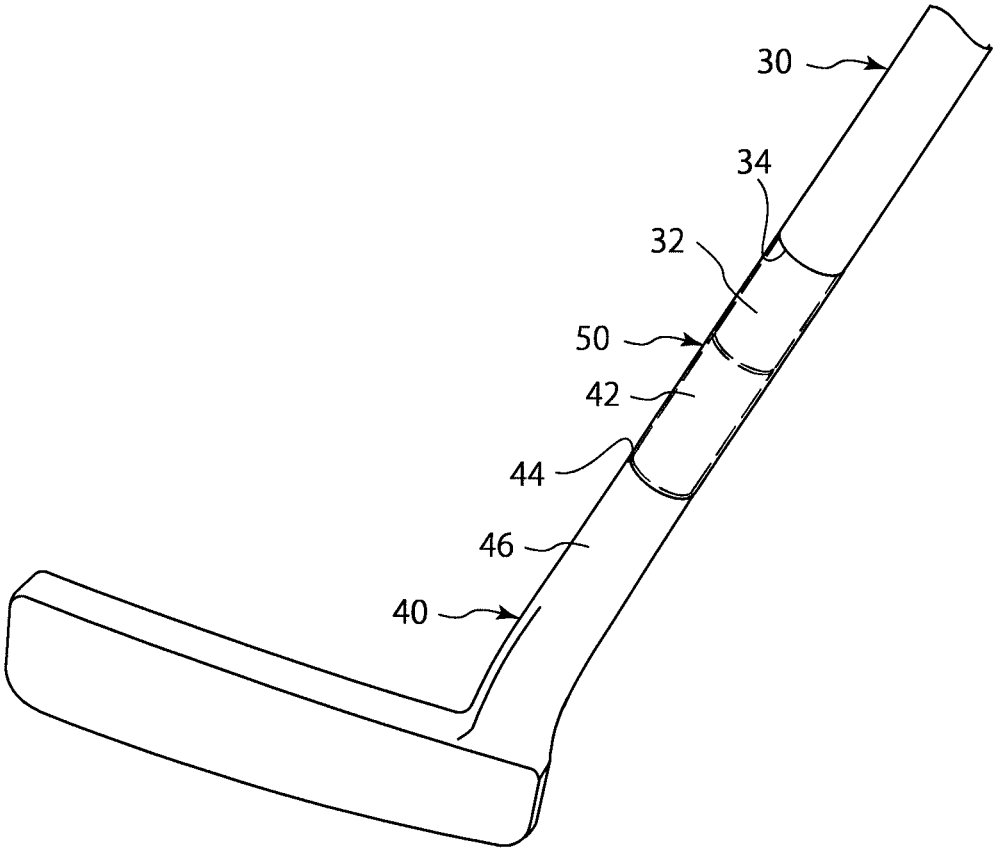
FIG. 10 is a perspective view illustrating a combined state of the carbon golf club shaft, the over-hosel-type golf club head (putter club head), and the tubular member.

FIG. 7 is a cross-sectional view illustrating a combined portion of the carbon golf club shaft 30, the over-hosel-type golf club head (putter club head) 40, and the tubular member 50. FIG. 8 is an enlarged view of a part VIII in FIG. 7. FIG. 9 and FIG. 10 are perspective views illustrating a separation state and a combined state of the carbon golf club shaft 30, the over-hosel-type golf club head (putter club head) 40, and the tubular member 50. In FIG. 10, an inside can be visually perceived by illustrating the tubular member 50 in skeleton.

The tubular member (the combining member) 50 is configured from, for example, a carbon (Carbon Fiber Reinforced Plastics (CFRP)) tubular member (combining member). More specifically, the tubular member 50 can be formed of a thermally cured prepreg where a thermosetting resin is immersed in a carbon fiber. As the prepreg (an uncured thermosetting resin prepreg), in addition to a UD prepreg where fiber directions are aligned in one direction, a biaxial woven fabric prepreg, a triaxial woven fabric prepreg, a quadraxial woven fabric prepreg, or the like can be used.

The inserted cylindrical portion 32 of the carbon golf club shaft 30 and the inserted shaft portion 42 of the over-hosel-type golf club head 40 are inserted into the tubular member 50 from opposite directions. The inserted cylindrical portion 32 and the inserted shaft portion 42 have approximately identical diameters, and the inserted cylindrical portion 32 has a distal end surface that is butted to a distal end surface of the inserted shaft portion 42 inside the tubular member 50 (FIG. 8). The tubular member 50 has one end portion (one end surface) that is abutted on the abutting stepped portion 34 of the carbon golf club shaft 30, and the tubular member 50 has another end portion (another end surface) that is abutted on the abutting stepped portion 44 of the over-hosel-type golf club head 40 (FIG. 8). Thus, the carbon golf club shaft 30, the over-hosel-type golf club head 40, and the tubular member 50 are assembled in a state where movement in the axial direction and the direction perpendicular to the axis is restricted (in a state where coaxiality is guaranteed).

A height of the abutting stepped portion 34, a height of the abutting stepped portion 44, and a thickness of the tubular member 50 are approximately identically set. As a result, an outer peripheral surface of the tubular member 50, an outer peripheral surface of a part on which the inserted cylindrical portion 32 is not formed (a part on a base end side with respect to the abutting stepped portion 34) in the carbon golf club shaft 30, and an outer peripheral surface of a part on which the inserted shaft portion 42 is not formed (a part on a base end side with respect to the abutting stepped portion 44) in the hosel 46 of the over-hosel-type golf club head 40 are approximately disposed on an identical plane (FIG. 8).

An adhesive is filled between the outer peripheral surfaces of the inserted cylindrical portion 32 and the inserted shaft portion 42 and an inner peripheral surface of the tubular member 50 to be bonded. The adhesive is filled between the distal end surface of the inserted cylindrical portion 32 and the distal end surface of the inserted shaft portion 42 to be bonded. Furthermore, the adhesive is filled between the abutting stepped portion 34 and the one end portion (the one end surface) of the tubular member 50 and between the abutting stepped portion 44 and the other end portion (the other end surface) of the tubular member 50 to be bonded. Thus, the carbon golf club shaft 30, the over-hosel-type golf club head 40, and the tubular member 50 are combined.

When the carbon golf club shaft 30, the over-hosel-type golf club head 40, and the tubular member 50 are combined, the adhesive is applied over the outer peripheral surface and the distal end surface of the inserted cylindrical portion 32 and the abutting stepped portion 34 in the golf club shaft 30, the outer peripheral surface and the distal end surface of the inserted shaft portion 42 and the abutting stepped portion 44 in the golf club head 40, and the inner peripheral surface of the tubular member 50. Then, the inserted cylindrical portion 32 of the carbon golf club shaft 30 and the inserted shaft portion 42 of the over-hosel-type golf club head 40 are inserted into the tubular member 50 the from opposite directions. Then, the distal end surface of the inserted cylindrical portion 32 is butted to the distal end surface of the inserted shaft portion 42 inside the tubular member 50, the one end portion (the one end surface) of the tubular member 50 is abutted on the abutting stepped portion 34, and the other end portion (the other end surface) of the tubular member 50 is abutted on the abutting stepped portion 44. The adhesive is cured in this state to combine the carbon golf club shaft 30, the over-hosel-type golf club head 40, and the tubular member 50.

Thus, the embodiment ensures the combination of the carbon golf club shaft (the inner-hosel-type golf club shaft) 30 and the over-hosel-type golf club head (putter club head) 40 using the tubular member (the combining member) 50 as the outside attachment. That is, the flexibility in choice of reshafting can be provided to the user regardless of the types of the golf club shaft and the golf club head.

In the above-described embodiment, an exemplary case has been described where the "inner-hosel-type golf club shaft" is the carbon golf club shaft. However, the "inner-hosel-type golf club shaft" is not limited to the carbon golf club shaft and may be one applicable to the inner-hosel-type golf club head but inapplicable to the over-hosel-type golf club head.

In the above-described embodiment, the exemplary case has been described where the "inner-hosel-type golf club shaft" is the carbon golf club shaft. However, the "inner-hosel-type golf club shaft" may be one formed of the thermally cured prepreg where the thermosetting resin is immersed in a reinforcing fiber, thus being not limited to the carbon one.

In the above-described embodiment, an exemplary case has been described where the tubular member (the combining member) is formed of the carbon tubular member (combining member). However, the tubular member (the combining member) may be one formed of the thermally cured prepreg where the thermosetting resin is immersed in the reinforcing fiber, thus being not limited to the carbon one.

In the above-described embodiment, an exemplary case has been described where the golf club head is the putter club head. However, the golf club head may be an iron club head or a driver club head.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A golf club comprising:

an inner-hosel-type golf club shaft which has an inserted cylindrical portion;

an over-hosel-type golf club head which has an inserted shaft portion; and a combining member that combines the inner-hosel-type golf club shaft with the over-hosel-type golf club head, the combining member being formed as a tubular member into which the inserted cylindrical portion and the inserted shaft portion are inserted from opposite directions, and the tubular member is bonded on outer peripheral surfaces of the inserted cylindrical portion and the inserted shaft portion.

2. The golf club according to claim 1, wherein the inserted cylindrical portion and the inserted shaft portion have distal end surfaces butted to one another inside the tubular member.

3. The golf club according to claim 1, wherein the inner-hosel-type golf club shaft defines the inserted cylindrical portion and has an abutting stepped portion on which one end portion of the tubular member is abutted, and the over-hosel-type golf club head defines the inserted shaft portion and has an abutting stepped portion on which another end portion of the tubular member is abutted.

4. The golf club according to claim 1, wherein the inner-hosel-type golf club shaft is formed of a golf club shaft formed of a thermally cured prepreg where a thermosetting resin is immersed in a reinforcing fiber.

5. The golf club according to claim 1, wherein the over-hosel-type golf club head is formed of a putter club head.

6. The golf club according to claim 1, wherein the combining member or the tubular member is formed of a thermally cured prepreg where a thermosetting resin is immersed in a reinforcing fiber.

7. In combination in a golf club having a golf club shaft with a cylindrical portion at one end of an inner-hosel-type club shaft, and a golf club head with a shaft portion of an over-hosel-type club head:

a combining member formed as a tubular member with one end and an opposite end, the cylindrical portion of the inner-hosel-type club shaft being inserted into the one end of the tubular member, and the shaft portion of the over-hosel-type club head being inserted into the opposite end of the tubular member, and the tubular member being bonded to outer peripheral surfaces of the inserted cylindrical portion and the inserted shaft portion.

8. A golf club comprising:

an inner-hosel-type golf club shaft which has an inserted cylindrical portion;

an over-hosel-type golf club head which has an inserted shaft portion; and a combining member that combines the inner-hosel-type golf club shaft with the over-hosel-type golf club head, the combining member having one end receiving the inserted cylindrical portion of the golf club shaft, and an opposite end receiving the inserted shaft portion of the golf club head, and the combining member is bonded at the ends to the inserted cylindrical portion and the inserted shaft portion.

* * * * *